United States Patent [19]

Lantz

[11] Patent Number: 4,688,281

[45] Date of Patent: Aug. 25, 1987

[54] PORTABLE AND COLLAPSIBLE BED ASSEMBLY

[76] Inventor: Gary W. Lantz, 25652 Skybird La., El Toro, Calif. 92630

[21] Appl. No.: 922,993

[22] Filed: Oct. 24, 1986

Related U.S. Application Data

[63] Continuation of Ser. No. 771,200, Aug. 30, 1985, abandoned, which is a continuation of Ser. No. 514,777, Jun. 17, 1983, abandoned, which is a continuation-in-part of Ser. No. 313,322, Oct. 20, 1981, abandoned.

[51] Int. Cl.[4] ..... A47C 19/16

[52] U.S. Cl. ..... 5/111; 5/114; 5/187

[58] Field of Search ..... 5/82 R, 110, 111, 114, 5/187

[56] References Cited

U.S. PATENT DOCUMENTS

| | | | |
|---|---|---|---|
| 2,611,908 | 9/1952 | Siggers | 5/187 |
| 2,670,478 | 3/1954 | Gilfillan | 5/82 |
| 2,678,085 | 5/1954 | DeMinno | 5/111 |
| 2,809,383 | 10/1957 | Fenner et al. | 5/114 |
| 2,858,551 | 11/1958 | Sidlinger | 5/114 |
| 2,871,489 | 2/1959 | Emmert | 5/114 |
| 2,970,323 | 2/1961 | Griffith et al. | 5/187 |
| 3,110,041 | 11/1963 | Fortin | 5/111 |
| 3,336,060 | 8/1967 | Bradford | 5/114 |
| 3,543,310 | 12/1970 | Smith | 5/111 |
| 3,620,428 | 11/1971 | Silverthorne | 5/114 |
| 3,798,685 | 3/1974 | Hunt et al. | 5/82 |

*Primary Examiner*—Gary L. Smith
*Assistant Examiner*—Michael F. Trettel
*Attorney, Agent, or Firm*—Drucker & Sommers

[57] ABSTRACT

A readily set-up and knocked-down portable bed assembly for animals or persons includes flexible sheeting for supporting such animal or person and a frame assembly which includes a plurality of interengageable short side members, connectable to the flexible sheeting so as to brace and support the flexible sheeting. Each frame side member includes opposite end portions interengageable with opposed complementary end portions of adjacently - positionable frame side members. For ready set up, the frame side members are adapted such that by linking of all but one pair of opposed frame side members end portions, the last non-linked opposed end portions of adjacently positioned frame side members overlap in the planar position, and are readily connectable by moving the non-linked end portions to a position skewed from the planar position of the otherwise partially assembled structure, in which position the flexible sheeting is bowed. The final position of the bed assembly is attained by stretching apart, aligning, engaging and interfitting the skewed end portions, and pressing the interfitted skewed end portions into the planar position. The procedure is reversed for ready knock-down of the bed assembly.

The bed, after assembly, may be rectangular, round, triangular or square or of some other shape. The bed is preferably spaced supported with respect to the ground by means of legs engaging the frame side members. The bed may be formed with cross-bracing intermediate the ends thereof functioning as legs and may also have a back rest or upstanding frame structure, supported by said frame side members, for the purpose of carrying webbing, and completely or partially enclosing the bed assembly.

19 Claims, 11 Drawing Figures

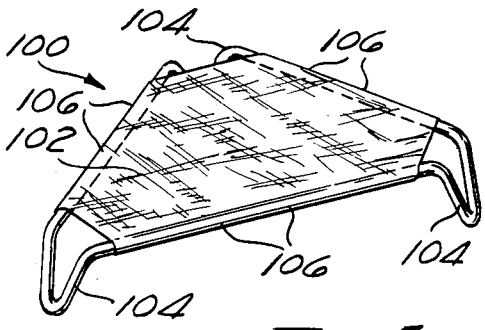
Fig. 5
Fig. 6
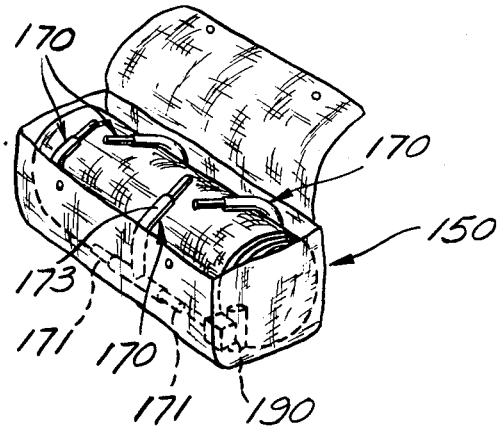
Fig. 7
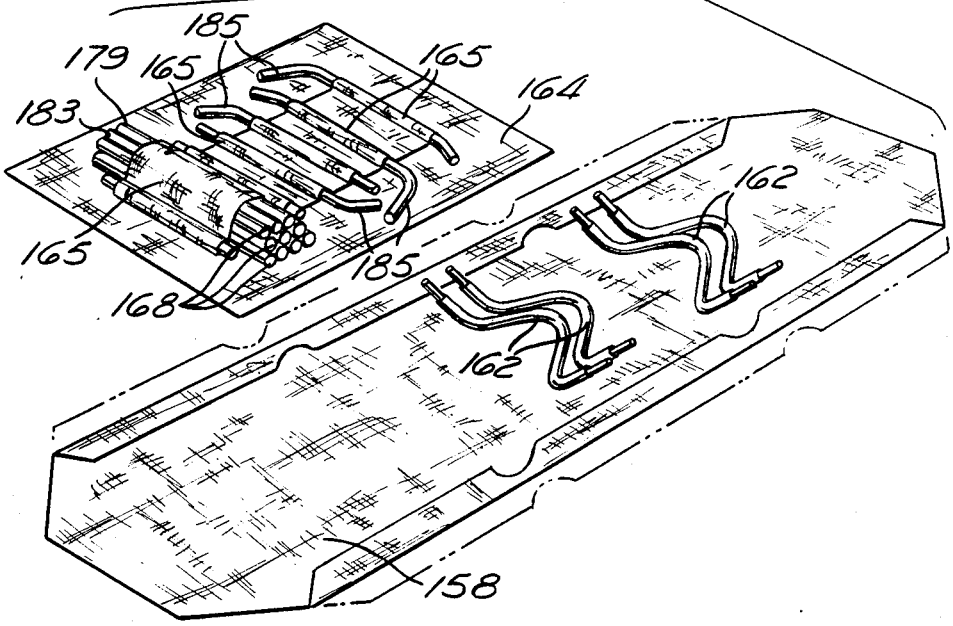

Fig. 8
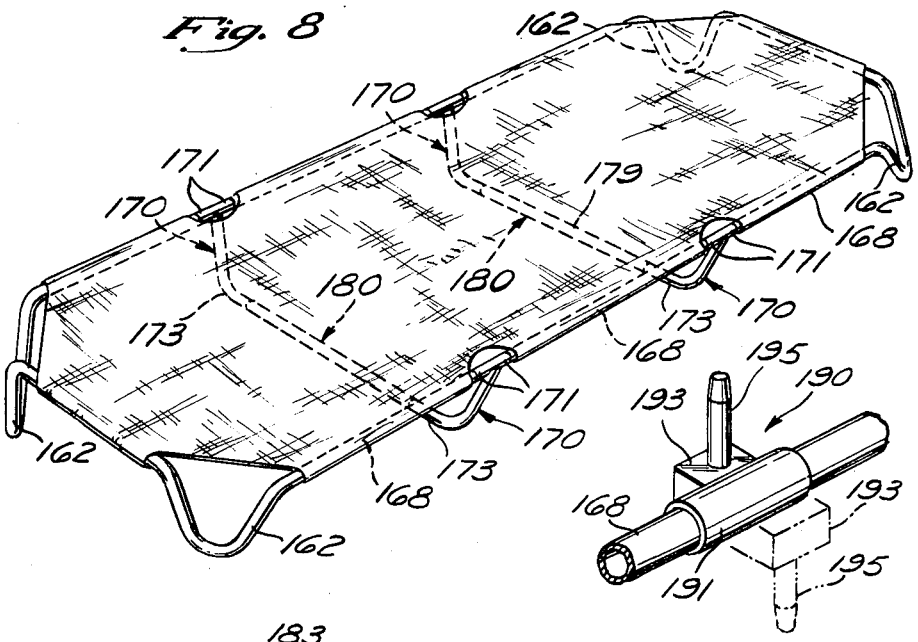
Fig. 9
Fig. 10
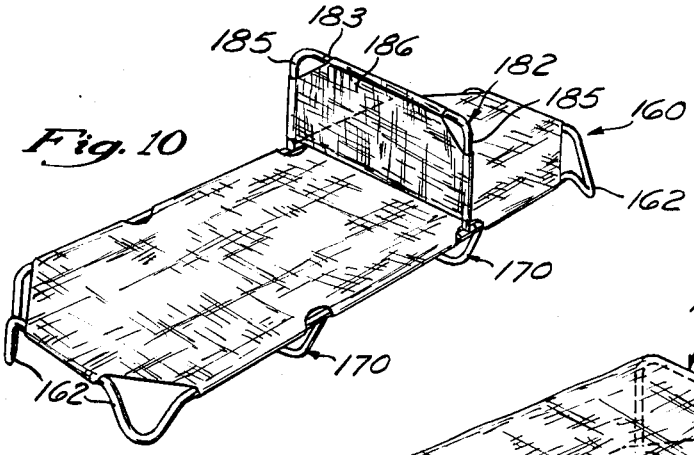
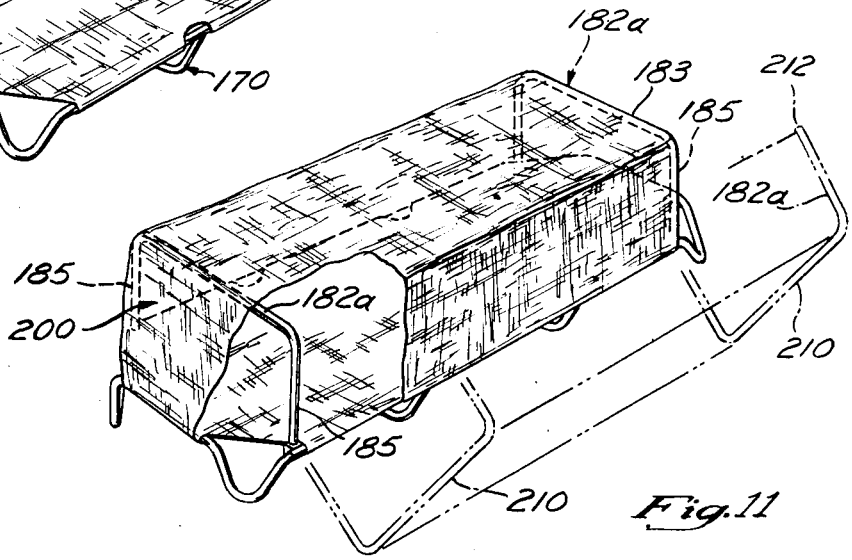
Fig. 11

PORTABLE AND COLLAPSIBLE BED ASSEMBLY

CROSS-REFERENCE TO RELATED APPLICATIONS

This application is a continuation of Ser. No. 771,200 filed Aug. 30, 1985, now abandoned, which is a continuation of Ser. No. 514,777 filed June 17, 1983, now abandoned, which is a continuation-in-part of Ser. No. 313,322, now abandoned, filed Oct. 20, 1981.

BACKGROUND OF THE INVENTION

The invention relates generally to beds, and, in particular, to a readily set-up and knocked-down bed assembly. The bed assembly of this invention has application to, and is particularly adapted for, supporting animals or persons.

BRIEF DESCRIPTION OF THE PRIOR ART

Previous units of this type have been relatively complex in design, requiring the assembly of many parts, which parts have been difficult to link so as to brace the support sheeting in the planar position, and have been likewise difficult to disassemble, such as the device disclosed in U.S. Pat. No. 2,809,383, entitled "TRAMPOLINES", and the device illustrated in the advertisement captioned "Sling Bed" in House Beautiful (October, 1964), Page 155. This is the closest prior art of which the applicant is aware.

SUMMARY OF THE INVENTION

The present invention is directed towards a portable readily set-up and knocked-down bed assembly, for supporting an animal or human in an elevated position above a floor or other support surface so as to enable the animal or human to sleep or rest thereon. The elements of the bed assembly are readily assembled and disasesmbled for convenient set-up and knock-down, enabling efficient carrying of the unit in its disassembled condition from place to place, while providing taut, flat, and stable support for the animal or person in its assembled condition.

Specifically, the invention disclosed herein, in one preferred form, is directed towards a bed assembly, including flexible sheeting, and a frame assembly for bracing the flexible sheeting upon assembly and interfitting thereof. The flexible sheeting includes long side portions having peripheral sleeves formed therein, and short corner portions having peripheral edges. The frame assembly includes a plurality of strut and leg members, interengageable so as to form the frame. Each strut member comprises a straight tubular member, extendable through one of the flexible sheeting side sleeves. Each leg member comprises a bent tubular member positionable so as to project normally downwardly from one of the flexible sheeting corner edges. At the opposite ends of each strut and leg member are end portions, one end portion being oversized, in diameter, relative to the other, which end portions are shaped so as to be complementary to an adjacently positionable end portion of another tubular member so as to be interengageable therewith.

Partial assembly of the bed is effected by inserting the tubular strut members so as to extend through the flexible sheeting side sleeves, and positioning the tubular leg members so as to project from the flexible sheeting corner edges, and linking all but one pair of opposed complemetary adjacent tubular member end portions.

Upon such partial assembly of the bed, the remaining non-linked pair of opposed complementary adjacent end portions are dimensionally structured so as to overlap in the plane of the flexible sheeting. It is necessary to enable such final non-linked opposed end portions to be readily linked and positioned in the plane of the flexible sheeting to complete assembly of the bed. For this purpose, the overlapping non-linked end portions are readily engageable by enabling movement of the non-linked end portions to a position skewed from the otherwise partially assembled structure, so that the flexible sheeting is bowed, and thus permitting the linkage to be made. The skewed corner is then pressed down, causing relative rotation of the finally linked end portions, so as to tighten, flatten, and stabilize the bed assembly.

The bed assembly of the present invention is more readily set-up and knocked-down than those of which we have knowledge, and provides a more taut, flat, and stabilized brace support for the flexible sheeting.

The bed assembly can be adapted to a variety of shapes, e.g., square, rectangular, triangular and circular. The bed assembly, in other embodiments, may be made with varying options such as a backrest, cross-bracing for additional strength and the addition of upstanding, transversely pivotally moveable frame members to support webbing for the purpose of enclosing the bed assembly. The bed assembly need not have legs at the corners for spaced support from a support surface. Instead the bed may have leg supports provided by the cross-bracing of the bed itself.

The bed assembly can be readily disassembled to a knock-down condition, packed in a bag in an organized manner, and readily transported to another location for set-up.

The bed assembly has other advantages which will become apparent from the detailed description and drawings contained herein.

BRIEF DESCRIPTION OF THE DRAWINGS

FIG. 5 is a perspective view of a second embodiment of the present invention;

FIG. 6 is a perspective view of carrying bag containing a third and fourth embodiment of the present invention, said embodiments being shown in completely disassembled and packed condition in said carrying bag;

FIG. 7 is a perspective view of said third embodiment shown in the unpacked state, but prior to assembly;

FIG. 8 is a perspective view of said third embodiment in assembled state;

FIG. 9 is a perspective view of a coupler module used for various further embodiments of this invention, e.g., as shown in FIGS. 10 and 11 hereof;

FIG. 10 is a perspective view of a fourth embodiment of this invention wherein a backrest is added to the back assembly by means of a plurality of support modules; and FIG. 11 is a perspective view of a fifth embodiment of this invention wherein upstanding frame members are added, by means of a plurality of support modules to support a webbing enclosure.

DESCRIPTION OF THE PREFERRED EMBODIMENTS

Figure 1:
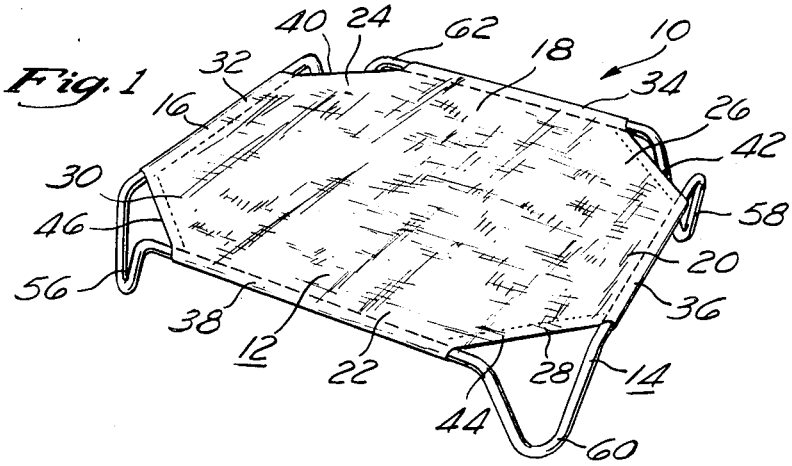
FIG. 1 is a perspective view of a first embodiment of the present invention.

Referring to FIG. 1, one preferred form of the bed assembly 10 of the present invention is shown assembled for supporting an animal such as a dog (or a person) for sleeping or resting thereon. The bed assembly 10 includes flexible sheeting 12, and a frame assembly 14, which extends, upon assembly, through portions of flexible sheeting 12 so as to brace flexible sheeting 12 in a taut, flat and stabilized configuration, and which projects, upon assembly, from portions of flexible sheeting 12 so as to support flexible sheeting 12 in a position elevated above a suitable support surface such as a floor or the like.

Figure 2:
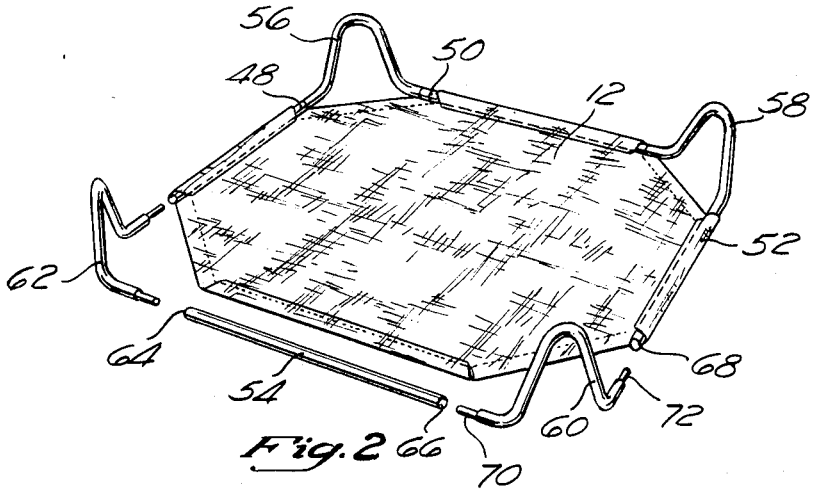
FIG. 2 is a partially exploded perspective view of the embodiment of FIG. 1.

Referring now to FIG. 2 as well as FIG. 1, flexible sheeting 12 includes side portions, 16, 18, 20, and 22, which are relatively long, and corner portions 24, 26, 28, and 30, which are relatively short. Peripheral sleeves 32, 34, 36, and 38 are integrally formed in flexible sheeting 12, as by folding in and stitching the peripheral edges so as to form such peripheral sleeves in side portions 16, 18, 20, and 22. Peripheral edges 40, 42, 44, and 46 are formed in corner portions 24, 26, 28, and 30. Flexible sheeting 12 is preferably formed of a lightweight, thin, strong and washable material such as a polyvinyl plastic, and is preferably octagonal in shape.

Frame assembly 14 includes strut members 48, 50, 52, and 54, and leg members 56, 58, 60 and 62, interengageable so as to form the bed frame. Strut members 48, 50, 52, and 54 are preferably tubular straight members, comprised of lightweight sturdy material such as aluminum. Each strut member, as 54, includes tubular end portions, as 64 and 66, and as end 68 in strut member 52. Leg members 48, 50, 52, and 54 are preferably tubular, bent, generally U-shaped members, likewise comprised of lightweight sturdy material such as aluminum. Each leg member, as 60, includes end portions, as 70 and 72, preferably made of wood for ease of rotation of such end portions within complementary, tubular, end portions of the metal strut members 48, 50, 52 and 54. Opposing end portions of adjacent strut and leg members, as end portion 66 of strut member 54 and end portion 70 of leg member 60, are interengageable or interfittable so as to link such members, and the round facing surfaces thereof, upon interengagement, permit rotation and movement of such members relative to each other. An end portion at one end of each tubular leg member, as end portion 70 of leg member 60, is oversized, and the end portion at the other end of each leg member, as end portion 72, is correspondingly reduced, relative to each other, for providing interengageable members for assembly of the bed.

This arrangement is interengageable and relatively rotatable and movable strut and leg members, as described above, enables orientation of such members for rapid interengagement or disengagement, as described below.

Figure 3:
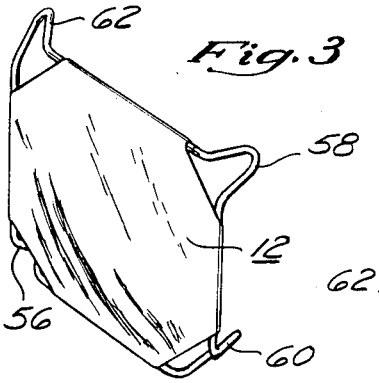
FIG. 3 is a perspective view of the embodiment of FIG. 1 supported on one side in a vertical position.
Figure 4:
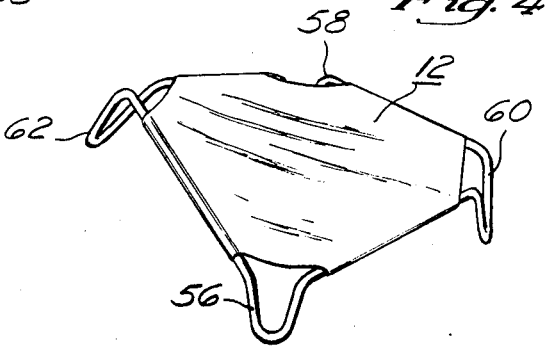
FIG. 4 is a perspective view of the first embodiment of FIG. 1 with one corner skewed from the plane of the other corners, and the flexible sheeting bowed.

Assembly of the bed, as shown in FIGS. 2–4, will now be described. The frame 14 and flexible sheeting 12 are partially assembled in the planar flat position, as shown in FIG. 2, and fully interconnected as shown in FIGS. 3–4 by extending frame strut members 48, 50, 52 and 54 through the respective sheeting peripheral sleeves 32, 34, 36, and 38 and engaging all but one end portion of frame leg members 56, 58, 60, and 62 in the opposed complementary end portions of adjacent frame strut members 48, 50, 52, and 54, whereupon the non-engaged pair of complementary frame member end portions overlap in a substantially planar flat position. The non-engaged pair of overlapping but complementary end portions are then engaged while in a generally vertical position, for added leverage, as shown in FIG. 3, by rotating and moving the members from which such end portions extend, relative to the other interengaged members, to a position skewed from the substantially planar position, in which position the flexible sheeting 12 is bowed, as shown in FIG. 4. The skewed end portions are then stretched apart, aligned, and interengaged. Such skewed interengaged end portions are then returned to the planar position by pressing down on the members from which such end portions extend, so as to rotate and move such members relative to the other interengaged members into the planar position, in which position the flexible sheeting 12 is flat, taut and stabilized, as shown in FIG. 1. The assembly procedure described above is reversed for disassembly.

In an alternate embodiment of the present invention, not shown in the drawings of FIGS. 1–4, adjacent pairs of separable strut and leg members are combined into four tubular side members or units, each integral tubular side member including a straight strut portion, a bent leg portion and interfittable end portions. As in the preferred embodiment described above, the side member strut portions are insertable so as to extend through the flexible sheeting sleeves, the side member leg portions are positionable so as to project from the flexible sheeting corners, and the last non-linked end portions overlap in the planar position and are interfitted by skewing, stretching, aligning, engaging, and pressing down such portions.

A second embodiment of animal bed 100 is shown in FIG. 5. In this embodiment, the strut member 106 and leg member 104 form a triangular framework for supporting sheeting or web 102. Web 102 is povided with peripheral sleeves and peripheral edges as in FIGS. 1–4, and is assembled to the strut and leg members 106, 104 in the same fashion as described with reference to FIGS. 1–4 except that the resulting assembled structure is triangular in configuration, and requires only three leg support members 104, one at each corner of bed 100. Triangular shapes of beds are particularly adapted for room corners, and are economical to manufacture. Other geometric shapes of small beds, for animals and the like, may be also constructed, such as circular beds, hectagon-shaped beds and the like (not shown in the drawings). In such cases, the struts forming the side frame members are appropriately bent to form the desired geometric shape, and the leg members will not, or need not, be at a corner of the bed. In the case of these additional shapes, the construction and assembly is the same as described with reference to FIGS. 1–4 hereof in that the struts are connected to the leg members 104 with the last paired units of strut and leg members being engaged with the bed in skewed fashion and pressed to a planar position.

Presently preferred embodiments of the bed for human use are shown in FIGS. 6–11. In all of these embodiments, the strut and leg members and other accessories or options are conveniently placed in organized fashion in a carrying bag or tote bag, designated by the numeral 150 in FIG. 6. The bag 150 contains all of the component parts required for the third and fourth embodiments of this invention shown in FIGS. 8, 9 and 10, most of these component parts being shown in unpacked, but disassembled, condition in FIG. 7.

Turning to FIG. 7, the flexible sheeting 158 forming the main bed support is unrolled to a flat position, as shown and the corner leg members 162 temporarily placed thereon. A carrying sheet 164, also initially contained within the bag 150, is unrolled. Carrying sheet 164 is provided with a plurality of sleeves 165 for stably carrying the straight members, e.g., strut members 168, cross-brace members 179, and bridging backrest member 183. Curved members 185 are also carried by sleeves 165, the curved cross-brace members 170 being loosely carried in the bag 150, as shown in FIG. 6. Component parts of the bed assembly can be readily re-packed, in a compact manner, in bag 150, by mounting the component parts within sleeves 165 of carrying sheet 164, and re-packing as shown in FIG. 6.

In the embodiment of FIG. 8, the bed assembly, designated 160, is assembled in essentially the same manner as described with reference to the bed assembly of FIGS. 1–4. However, in the FIG. 8 embodiment, since the bed configuration is elongated, for use of an adult or child, it is preferably provided with a pair of U-shaped cross-bracing units 180 intermediate the ends of the bed assembly 160. Each cross-bracing unit 180 preferably comprises a pair downwardly projecting curved leg members 170, the leg members 170 having upper transversely extending end portions 171 (as best shown in FIG. 6) mateably interfitting within the ends of adjacent strut members 168 extending through the peripheral sleeves of sheeting 160. The stem portions 173 of leg members 170 engage within the ends of straight, bridging members 179 to form a pair of U-shaped cross-member units 180 intermediate the ends of the bed assembly 160. The cross-member units 180 may also function as the only leg supports for the bed 160, and corner leg members 162 need not be used. If corner leg members 162 are not employed, they may be replaced by corner members which are essentially planar, i.e., have no downward projection (not shown).

The bed assembly 160 is assembled by preferably interfitting adjacent end portions all strut, leg members and cross-bracing units 168, 162 and 180, respectively, except for one ajdacent pair of leg and strut members 162 and 168. The non-interfitted adjacent pair of members will overlap in the planar position of the bed assembly and are interfittable by engaging complementary relatively rotatable end portions of these adjacent members in a position skewed from the planar position, such interfitted skewed adjacent members being returnable to the planar position by relative movement thereof into the planar position.

Referring now to the FIG. 10 embodiment, this embodiment is the same as that of FIG. 8 except that a backrest support option is provided. The backrest support, designated generally by the numeral 182 is supported, in upstanding position relative to the bed assembly 160, by means of a pair of transversely aligned support blocks or modules 190, an enlargement of one of which is shown in FIG. 9. Each support module 190 comprises a tubular metal sleeve 191 loosely rotatably mounted onto a strut member 168 (prior to full assembly of the bed 160) so as to be readily rotatable about the axis of strut member 168. Each support module 190 has affixed thereto a block or plate member 193 carrying a normally upwardly projecting (when in use) tapered support pin or support means 195. The assembly of bed 160 is then completed in the manner previously described.

The backrest unit 182 is completed by affixing a backrest sheeting 186, onto the inversely U-shaped backrest framework, comprising a pair of curved backrest end members 185 and bridging backrest member 183, in a conventional manner, e.g., by slipping the backrest members 185, 183 through peripheral sleeves formed in the sheeting 186. The backrest end members 185 have their lower ends projecting from the sheeting 186 and mateably engage the projecting generally cylindrical support pins 195 and thereby position the backrest unit 182 into operative position.

The backrest unit 182 is readily entirely removeable from the bed assembly 160 merely by use of slight upward force on the backrest unit 182 in which case the bed assembly 160 can again be used for reclining or sleeping purposes. When the backrest unit 182 is removed, the support module is readily rotatably moved to the phantom line position shown in FIG. 9, the pin 195 then being placed in a downward, out-of-the-way position.

In FIG. 10, the backrest support 182 is shown positioned intermediate the ends of the bed 160. In FIG. 11, a tent-like enclosure 200 is provided for the bed assembly of FIG. 8 (the bed assembly of FIG. 1 being designated 202). A pair of support frameworks **182*a* each comprising end backrest members 185 and bridging member 183 supported by support modules 190, are positioned near each end of bed assembly 202 and form a pair of upstanding supports for the enclosure 200**. The enclosure may be a porous sheet of plastic or other material and may be used as a protective enclosure while one is sleeping outdoors.

Each of the support frameworks **182*a* in the FIG. 11 embodiment are assembled by rotatably mounting pairs of the support modules 190 onto appropriate strut members 168, as earlier described, prior to full assembly of the bed 202, then completing assembly of the bed structure as described previously. The support frameworks 182*a* can then be completed and the enclosure 200** positioned thereon as shown.

The support frameworks **182*a* are transversely pivotally moveable to the position shown in phantom line 210 by FIG. 11 by releasing one lower end 212 only of the backrest support frameworks 182*a* from its support pin whereby each of the entire frameworks 182*a* can be rotatably moved about the axis of the opposite side of the bed structure 202 because of the rotatable mounting of the support modules 190 to the strut members of the bed structure, as previously described. In this manner, a person can readily lie on the bed structure 202, and enclose himself or herself beneath the enclosure 200**, or conversely, release oneself from the enclosure.

While the projecting ends of the frame leg members have been shown in the various embodiments as including separate wooden dowels, the invention includes projecting ends in the form of a reduced-diameter tubular leg member end portions, complementary in shape and interengageable in tubular end portions of adjacent strut members. All of the component parts shown, i.e., the strut leg, backrest and leg brace members are preferably, all less than 18" in length, for eash of carrying in bag 150.

The present invention is of efficient and convenient design, substantially reducing the number of parts constituting the bed assembly, with consequent reduction of time and effort required for assembly and disassembly of the bed. These and other advantages will be appreciated by those skilled in the art from the present specification.

While, the above description, preferred and alternate embodiments of the invention have been set forth for purposes of explanation, it will be understood that variations and changes may be made therein without departing from the scope and spirit of the invention.

I claim:

1. A bed assembly kit adapted to be readily set-up or knocked-down, comprising:

(a) flexible sheeting, adapted to be supported in a position elevated above a support surface, which flexible sheeting includes a plurality of side portions each of which includes a peripheral sleeve; and (b) frame assembly members, adapted to support the flexible sheeting in the position elevated above said support surface, including a plurality of interfittable strut and leg members adapted to define a framework, each of the strut members adapted to extend through said peripheral sleeves of said flexible sheeting and each of said leg members adapted to project downwardly from said strut members, all but one adjacently positionable pair of the interfittable members of said framework being adapted to interfit so as to form a partially assembled bed assembly in a substantially planar position, and the remaining non-interfitted adjacently positionable pair of members being adapted to overlap in the said substantially planar position and to enable the non-interfitted portion to be skewed from the substantially planar position so as to be interfittable by engaging complementary end portions of said adjacent members in the position skewed from said substantially planar position, said complementary end portions of said adjacent members being relatively rotatable with respect to each other, and such interfittable skewed adjacent pair of members being adapted to be returnable to the planar position by relative rotational movement thereof into the said substantially planar position.

2. A bed assembly as in claim 1, in which the flexible sheeting is further adapted to be supported in a taut position upon complete interfitting of said frame assembly.

3. A bed assembly as in claim 1, in which the end portions of each strut member are tubular, and a dowel is secured in one end of each strut member so as to project therefrom.

4. A bed assembly as in claim 1, in which the end portions of each strut member are tubular, and one tubular end portion of each strut member is reduced in diameter.

5. A bed assembly as in claim 1 wherein said complementary end portions of said adjacent members are moved into substantially planar position after the interfitting thereof by relative rotatable movement from said skewed position to said substantially planar position.

6. A bed as in claim 1, in which each strut member is straight.

7. A bed assembly as in claim 1 in which the flexible sheeting is generally octagonal-shaped.

8. A bed assembly as in claim 1 in which the flexible sheeting is generally circular-shaped.

9. A bed assembly as in claim 1 in which the flexible sheeting is generally elongated.

10. A bed assembly as in claim 1 in which the flexible sheeting is generally square-shaped.

11. A bed as in claim 1 in which each leg member is generally U-shaped.

12. A bed assembly as in claim 1 in which each leg member is interfittable between strut members at the corners of said bed assembly.

13. A bed assembly as in claim 1 in which each leg member is interfittable between strut members intermediate the ends of said bed assembly.

14. A bed assembly as in claim 1 further comprising: a flexible carrying sheet having a plurality of sleeves formed therein, defining holding means for at least some of said members defining said frame assembly of said bed assembly.

15. The bed assembly of claim 1 further comprising a bag dimensioned to hold said flexible sheeting, said carrying sheet and said members defining said frame assembly.

16. The bed assembly of claim 1 further comprising: at least one pair of support modules, each support module being rotatably mounted onto a strut member and having a support means affixed thereto, a support framework for sheet material, the ends of said support framework being engageable with and supported by said support means.

17. The bed assembly of claim 1 wherein said support means of each support module comprises a cylindrical projection.

18. The bed assembly of claim 1 wherein said pair of support modules is rotatably mounted to said strut members in transverse alignment intermediate the ends of said bed assembly to provide, with said support framework a transversely pivotal backrest support.

19. The bed assembly of claim 1 further comprising: at least one pair of transversely aligned support modules rotatably mounted to said strut members, each support module pair being mounted near the ends of said bed assembly to provide, with said support framework engageable by said support means of said support modules, at least one transversely pivotal upstanding support.

* * * * *